US007921603B2

(12) United States Patent
Darnell

(10) Patent No.: US 7,921,603 B2
(45) Date of Patent: Apr. 12, 2011

(54) SYSTEMS FOR A FIRE-RESISTANT DOOR JAMB

(76) Inventor: Duane Darnell, Redmond, OR (US)

( * ) Notice: Subject to any disclaimer, the term of this patent is extended or adjusted under 35 U.S.C. 154(b) by 908 days.

(21) Appl. No.: 11/009,384

(22) Filed: Dec. 8, 2004

(65) Prior Publication Data

US 2006/0048466 A1 Mar. 9, 2006

Related U.S. Application Data

(60) Provisional application No. 60/609,000, filed on Sep. 9, 2004.

(51) Int. Cl.
*E06B 1/04* (2006.01)

(52) U.S. Cl. ..... 49/504; 49/505; 52/213; 52/656.3

(58) Field of Classification Search ..... 49/504, 49/505; 52/204.1, 656.3, 656.2, 210, 213
See application file for complete search history.

(56) References Cited

U.S. PATENT DOCUMENTS 338,008 A * 3/1886 Sklar ..... 278/65
1,531,228 A * 3/1925 Zimmer ..... 52/213
1,599,985 A * 9/1926 Carlson ..... 52/213
2,711,564 A 6/1955 Jackson
2,736,930 A 3/1956 Longley
2,853,161 A 9/1958 Mascari
2,997,750 A 8/1961 Lester
3,040,390 A 6/1962 Carlton
3,226,781 A * 1/1966 Schnabel ..... 52/98
3,239,978 A 3/1966 Parker
3,420,003 A 1/1969 Cline
3,491,487 A * 1/1970 Cherno Philip R ..... 49/504
3,520,085 A 7/1970 Pond
3,545,135 A 12/1970 Lieber
3,599,373 A 8/1971 Goykendall
3,609,928 A 10/1971 Mock
3,707,057 A 12/1972 Frydenberg
3,741,068 A * 6/1973 Andruskiewicz ..... 411/461
3,757,473 A 9/1973 Mundy
3,800,488 A 4/1974 Swanson
3,981,103 A 9/1976 McAllister
4,012,868 A 3/1977 Andruszkiewicz
4,154,034 A * 5/1979 Bursk et al. ..... 52/213
4,223,494 A 9/1980 Wendt
4,281,480 A 8/1981 Wendt
4,343,127 A 8/1982 Greve et al.
4,367,614 A 1/1983 Warwick
4,473,981 A 10/1984 Simpson
4,589,229 A 5/1986 Warren
4,811,533 A 3/1989 Wetsel
5,105,596 A 4/1992 Wertitsch et al.
5,231,935 A * 8/1993 Oder et al. ..... 109/59 R
5,437,130 A 8/1995 Raynak
5,816,017 A 10/1998 Hunt et al.
6,115,976 A 9/2000 Gomez
6,178,717 B1 * 1/2001 Loop ..... 52/714
6,293,061 B1 * 9/2001 Horak, Jr. ..... 52/213
6,434,899 B1 8/2002 Fortin et al.
6,643,991 B1 11/2003 Moyes
6,745,526 B1 6/2004 Autovino
2001/0018817 A1 * 9/2001 Degelsegger ..... 52/784.11
(Continued)

*Primary Examiner* — Gregory J. Strimbu
(74) *Attorney, Agent, or Firm* — Kolisch Hartwell, P.C.

(57) ABSTRACT

A fire-resistant door jamb system may incorporate wood components, fire-resistant material, intumescent material and may include a bracket set including an L-shaped fixed bracket for installing a door jamb assembly in a wall.

5 Claims, 4 Drawing Sheets

U.S. PATENT DOCUMENTS

2002/0124497 A1 9/2002 Fortin et al.
2003/0159361 A1* 8/2003 Yeremian ..... 49/504
2003/0167709 A1* 9/2003 Harkins et al. ..... 52/204.1
2005/0284030 A1* 12/2005 Autovino et al. ..... 52/1

* cited by examiner

SYSTEMS FOR A FIRE-RESISTANT DOOR JAMB

CROSS-REFERENCE TO RELATED APPLICATION

This application claims priority under 35 U.S.C. §119 and applicable foreign and international law of U.S. Provisional Patent Application Ser. No. 60/609,000 filed Sep. 9, 2004 which is hereby incorporated by reference in its entirety for all purposes.

FIELD OF THE INVENTION

The invention relates to fire-resistant door jamb systems. Particularly, jamb assemblies comprised of wood components.

BACKGROUND

It is often necessary or desirable to install fire-resistant doors in buildings. Fire-resistant doors are typically quite heavy and require special fire-resistant jambs for support. Metal door jambs are often used in conjunction with doors consisting of fire-resistant materials. Metal jambs may be unsatisfactory aesthetically if the appearance of wood detail is desired. Accordingly, there is a need for fire-resistant door jamb systems that use wood components.

SUMMARY

In one example, a door jamb may include a hinge leg and a strike leg connected via a header, each of the legs and header including fire-resistant wood components and integrated intumescent material.

A bracket system may be used to install a jamb in a wall. One example of a bracket system uses adjustable brackets to accommodate varying wall thickness. Another example uses reinforced coupling bracket structure connecting a fire door to the jamb and the wall via hinges. Described examples provide fire-resistant door jamb systems that achieve standard 60- and 90-minute fire rating.

DESCRIPTION

Figure 2:
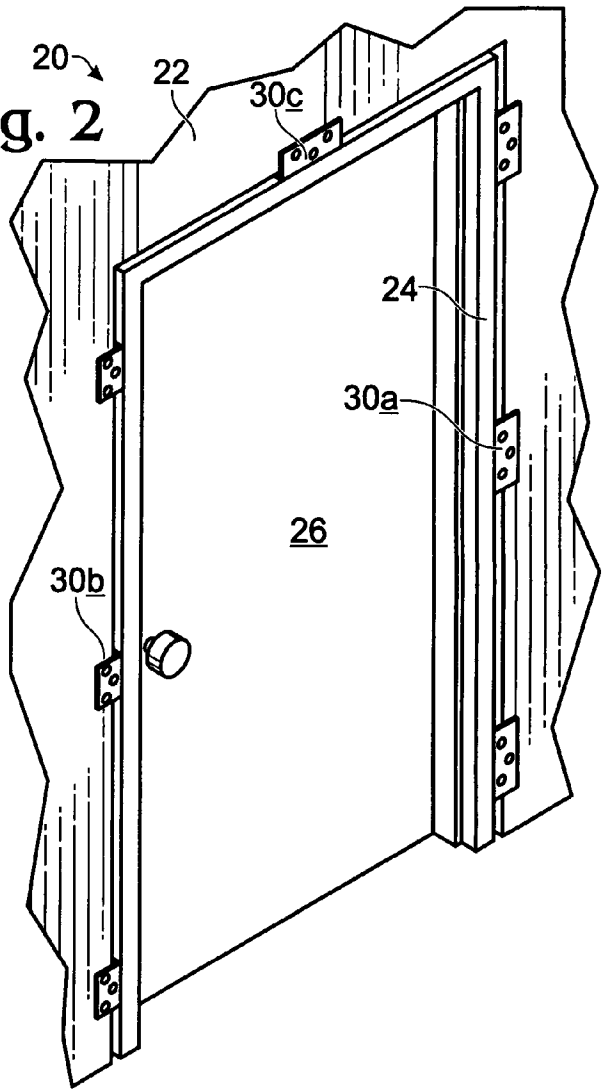
FIG. 2 is a perspective view of the back side of the door system shown in FIG. 1.
Figure 1:
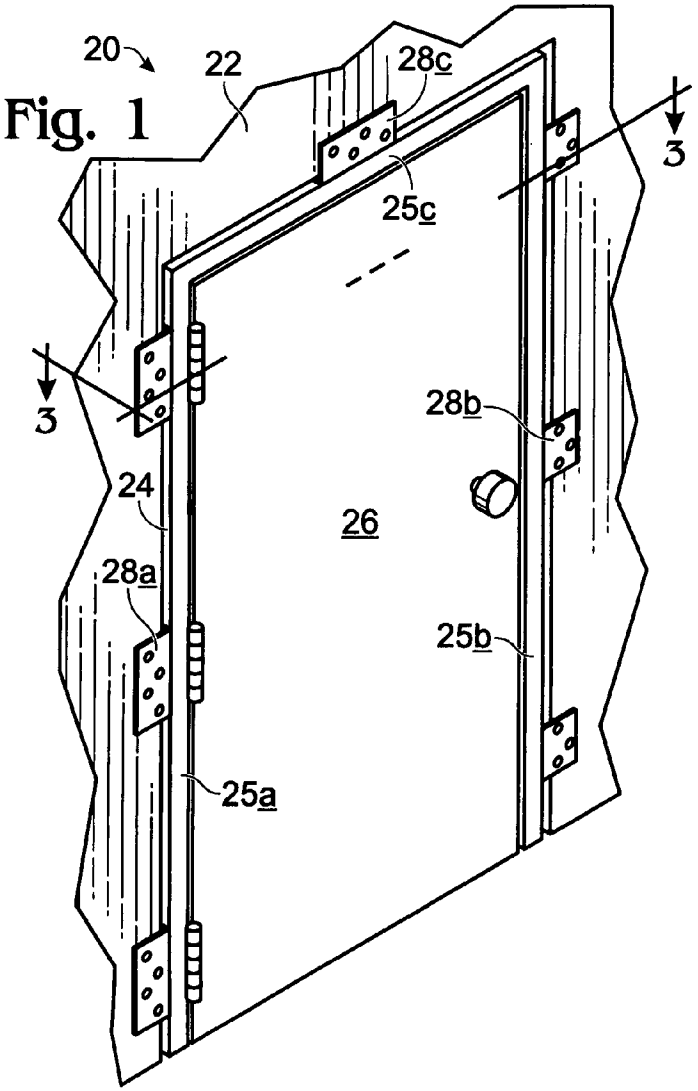
FIG. 1 is a perspective view of a fire-resistant door jamb system installed in a wall.

In FIG. 1, fire-resistant door jamb system 20 is installed in an opening in wall 22. Jamb 24 includes three main components: hinge leg 25*a*, strike leg 25*b*, and header 25*c*. Door 26 is supported by jamb 24. Jamb 24 is secured to wall 22 via brackets, namely, hinge leg brackets 28*a*, strike leg brackets 28*b* and header bracket 28*c*. As shown in FIG. 2, a complementing set of brackets 30*a*, 30*b*, 30*c* are used to attach jamb 24 on the back side of wall 22. In a preferred example, the front side hinge leg brackets 28*a* are 5-inches long. The other front and back side brackets are 3-inches long. The front side hinge leg brackets are larger because they may be relied on to provide crucial support to the door, via the hinges, during a fire situation. Other bracket shapes, sizes and numbers may also be used. For example, instead of these brackets per leg per side, one continuous long bracket may be used.

Figure 3:
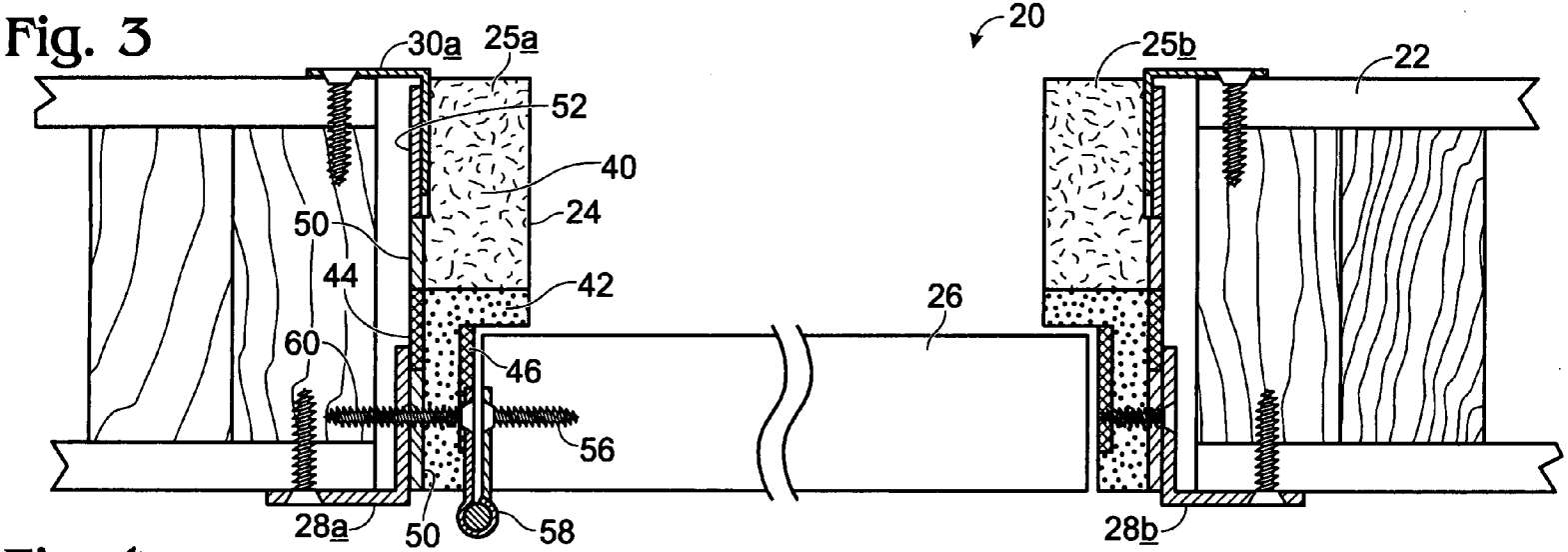
FIG. 3 is a partial cross-sectional view of the fire-resistant door jamb system shown in FIG. 1.

FIG. 3 shows a cross section through jamb system 20 illustrating details relating to fastening and securing of the jamb within the wall opening. Jamb 24 includes portion 40, which may be made, for example, of an inexpensive finger-jointed wood material such as pine, cherry, oak, maple or TECTONITE® diatomaceous earth material. Portion 40 is connected to TECTONITE® diatomaceous earth component 42. Intumescent strips or sheets 44 and 46 are secured on opposite sides of jamb 24. Hard board composite sheets 50 may also be used on the back side of jamb 24 for the purpose of increasing screw-holding capacity.

Fixed metal brackets 52 may be secured to the back side of jamb 24 by screws (not shown) to create a pocket for receiving adjustable brackets 30*a*. In the example shown in FIG. 3, the fixed bracket is installed in a recess in the back of jamb 24. In other examples the fixed bracket may be attached to the surface of the jamb without any recess (see FIGS. 8-10). Screws 56 are used to secure hinge 58 to door 26. Screws 60 secure hinge 58 to jamb 24 and extend further into wall 22, providing increased strength to the doorjamb system, even during a fire when the door, jamb and wall may be in a deteriorated state. For each hinge-leg bracket three screws may be used to secure the bracket to the jamb prior to installing the jamb in the wall. The jamb is pre-drilled with holes for securing the hinges. Prior to attaching the hinge to the jamb, a drill is used to cut holes in the hinge leg bracket in-line with the pre-drilled hinge holes. Relatively long screws are then screwed in through the hinge, one of the intumescent strips, jamb, hinge leg bracket and wall. Doorjamb system 20, as shown in FIG. 3, has been tested and received a 90-minute fire rating. In this application a timed fire rating means that the door/jamb system has been tested using a standard procedure conducted by a widely used and accepted agency such as Interteck Testing Services (ITS) or Underwriters Laboratories. Fire rating experiments referred to in this application were performed by an ITS engineer at an ITS Laboratory.

Figure 4:
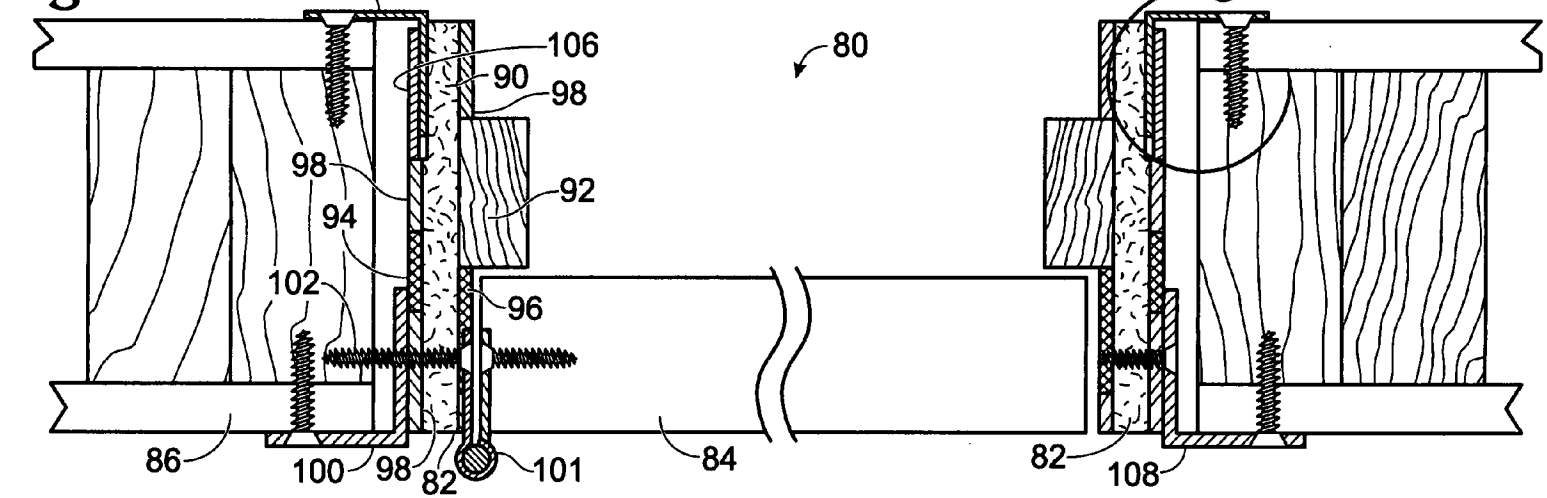
FIG. 4 is a partial cross-sectional view of an alternative fire-resistant door jamb system.

FIG. 4 shows another example of a fire-rated door. Door jamb system 80 has been tested and received a 60-minute firing rating. Door jamb system 80 is similar in many respects to door jamb system 20. However, door jamb system 80 does not include any diatomaceous earth component such as 42 in FIG. 3.

As shown in FIG. 4, jamb 82 supports door 84 within an opening in wall 86. Base portion 90 is preferably made of a fire-resistant particle board. For example, a preferred fire-resistant particle board is available from Spanolux under the trademark SPANO ANTIVLAM®. Wood stop member 92 is mounted on base portion 90. Intumescent strips 94 and 96 are mounted on opposite sides of base portion 90. Hard board composite layers 98 may also be used on the back side of jamb 82 primarily for increasing screw-holding capacity. Front bracket 100 is used to secure the front side of jamb 82 to wall 86, and also to strengthen the connection between door 84 to wall 86 via hinge 101 and long screws 102. Adjustable bracket member 104 is received in a pocket created by fixed metal bracket component 106. Similar jamb construction and bracketing system is used on the strike leg. However, as shown in FIG. 4, fixed bracket 108 is secured to jamb 82, but not to any hinge or door 84. Brackets 108 are preferably 3-inches long, whereas brackets 100 are 5-inches long.

Figure 5:
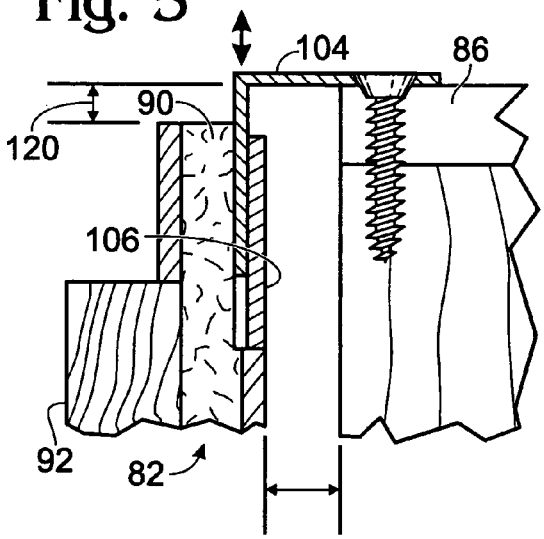
FIGS. 5 and 6 are partial cross-sectional views of a fire-resistant door jamb system installed in walls of different thickness.
Figure 6:
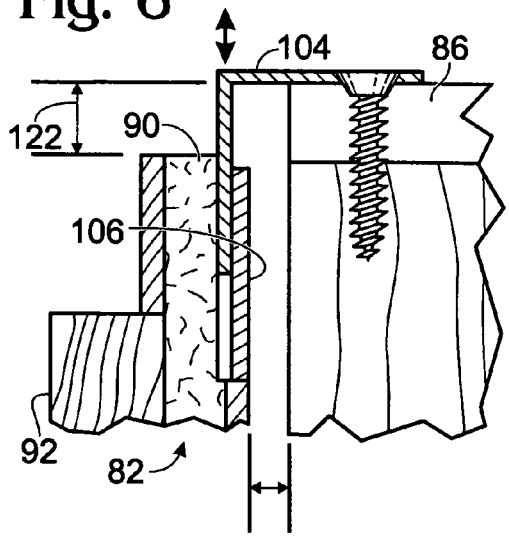

FIGS. 5 and 6 focus on adjustable brackets used to secure the back side of jamb 82 to wall 86, as shown in FIG. 2. A pocket is created on the outside of jamb 82 by fixed metal plate 106. Note that plate 106 is screwed (shown in FIG. 7) to base portion 90. Adjustable bracket member 104 may slide to a variable extent in the pocket to accommodate walls of different thickness. FIGS. 5 and 6 show the same bracket system being used to fasten jamb 82 to walls of different thickness. Distance 120 in FIG. 5 is smaller than distance 122 in FIG. 6, representing the differences in wall thickness, i.e., the wall in FIG. 5 is thicker than the wall in FIG. 6.

Figure 7:
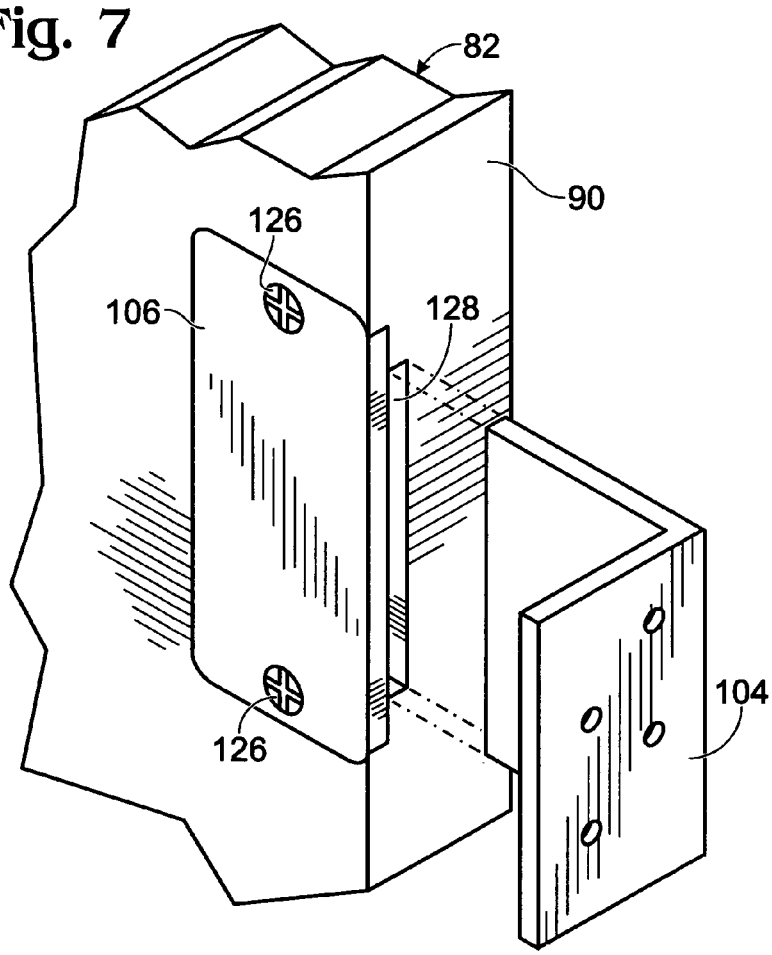
FIG. 7 is a partial perspective view of a bracket device used to accommodate walls of different thickness.

FIG. 7 shows a partial perspective view of adjustable bracket 104 in relation to pocket 128. Fixed metal plate 106 is fastened to base portion 90 via screws 126, thereby creating pocket 128 for receiving adjustable bracket 104.

Figure 8:
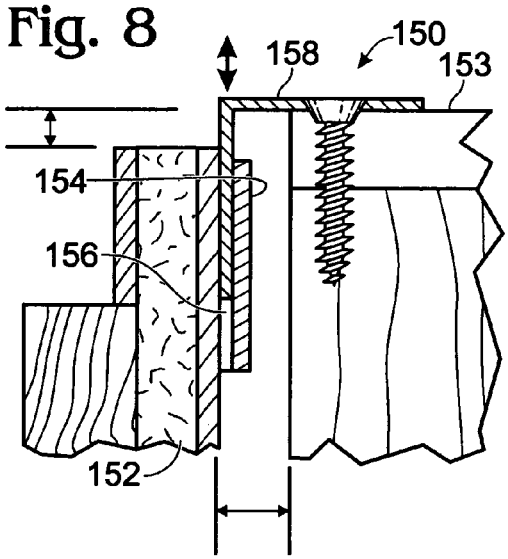
FIGS. 8 and 9 are partial cross-sectional views of a fire-resistant door jamb system installed in walls of different thickness.
Figure 9:
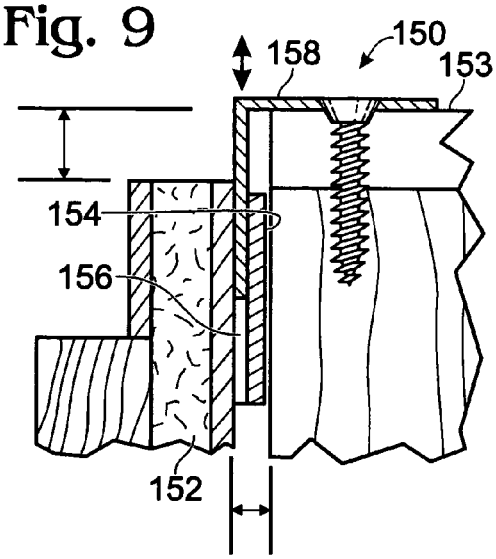
Figure 10:
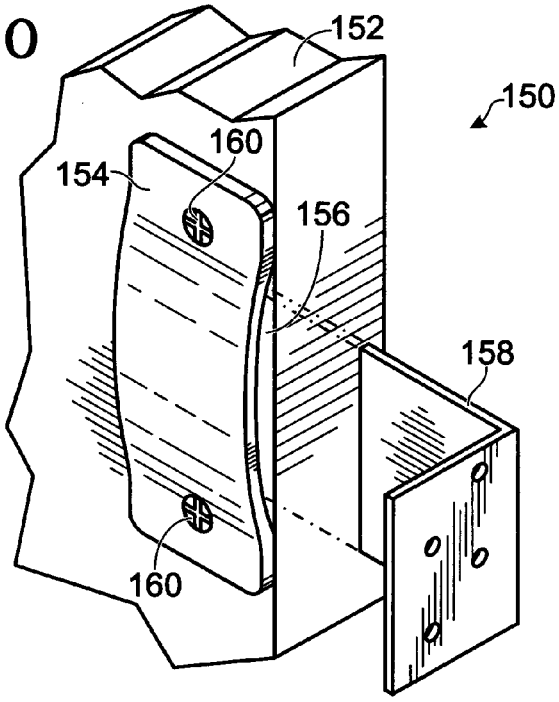
FIG. 10 is a partial perspective view of a bracket device used to accommodate walls of different thickness.

FIGS. 8-10 show an alternative adjustable bracket system. As shown in FIG. 8, bracket system 150 connects the jamb 152 to the back side of wall 153. Fixed curved, or stepped plate number 154 is attached to jamb 152, as shown in FIG. 10. The curvature in fixed curved plate 154 creates pocket 156 for receiving adjustable bracket member 158. FIGS. 8 and 9 show adjustable bracket member 158 extending to different extents in pocket 156 to accommodate walls of different thickness.

FIG. 10 shows a partial perspective view of bracket system 150 prior to inserting adjustable bracket member 158 into pocket 156. As shown in FIG. 10, screws 160 attach plate member 154 to the surface of jamb 152 without any recess.

Figure 11:
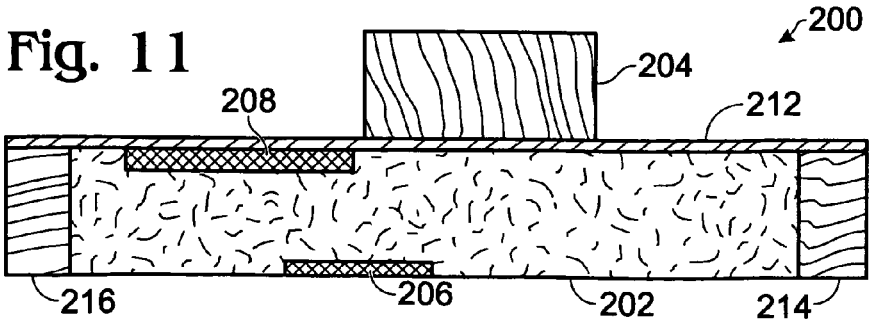
FIG. 11 is a cross-sectional view of a jamb leg in another example of a fire-resistant door jamb system.

FIG. 11 shows an alternative fire-resistant door jamb configuration which has received a 60-minute fire rating. Jamb system 200 includes base portion 202, made preferably of a fire-resistant particle board. For example, base portion 202 may be a particle board composition including fire-resistant chemicals such as mono ammonium phosphate, mono potassium phosphate, other fire-resistant chemicals, or mixtures thereof. Wood stop member 204 is attached to base portion 202. Intumescent sheets 206 and 208 are attached to opposite sides of base portion 202. For example, an intumescent product known as PALUSOL 100 may be used. Wood veneer layers 212 are attached to the inside of base portion 202 so that the visible portions of jamb system 200, after installation, appear to be solid wood. Wood end portions 214 and 216 may also be attached to base portion 202 for the same purpose.

A door jamb kit may come with two legs and one header. The kit also may include a bracket system for installing the jamb in a wall opening. In general, the hinge leg may have a front face bracket corresponding to each door hinge. Further, a slot bracket and rear slide bracket is provided corresponding to each front face bracket. The strike leg may have the same number of brackets as the hinge leg or may have a different number. The brackets on the strike leg may be smaller because they support less load compared to the hinge leg. The header may have one or more sets of brackets, i.e., one front face bracket, one slot bracket, and one rear slide bracket.

As explained in more detail below, the front face brackets are intended to mount the front of the jamb flush with one side of the wall. Once the front face brackets are secured, then the corresponding rear slide brackets are inserted in respective slot brackets so that the rear slide brackets mount on the rear corner of the wall opening. The rear side brackets are then attached to the wall via screws. Accordingly, the rear slide brackets do not fix or secure the front-to-back position of the jamb in a wall opening, however, they assist in securing the doorjamb relative to up-down and side-to-side movement across the wall opening. The slide characteristic of the bracket permits installation of the jamb in walls of varying thickness.

The jamb systems described above permit a simple and straight forward method of installing a jamb. The bracket systems may have broad application to jamb systems even outside of the market for fire-resistant constructions. Generally, the legs and header are supplied unassembled. In some instances, the legs and header are supplied with mounting brackets pre-attached. In other instances, for example, if the jamb needs to be treated or painted prior to mounting, then the legs and header are supplied without pre-attaching the brackets. If necessary, the installation process is initiated by securing the brackets to the legs and header. The brackets are attached on the hinge leg at locations corresponding to the door hinges. The brackets may come with holes pre-drilled. Alternatively, the brackets may come without pre-drilled holes, in which case a jamb kit may include an appropriate drill bit for drilling holes in the brackets. The jamb legs may be provided with holes predrilled for attaching the door hinges.

Once the brackets are mounted on the legs and header, then the legs and header are laid down on the floor with the header away from the opening. Four screws are then used to attach the header to the legs. The jamb is then lifted up into the wall opening.

The installer then levels and attaches the hinge leg in the opening by screwing the front faced brackets into the face of the wall. Preferably, the top hinge bracket is secured before the bottom hinge bracket. Next, the header is leveled to be perpendicular with the hinge leg. The front face bracket on the header is then screwed into the wall. The installer then levels and secures the strike leg by screwing the brackets to the front face of the wall.

Once all sides of the jamb are appropriately level and positioned properly, then all of the screws on the front side are secured and tightened. A spreader bar may also be provided in the jamb kit for assisting with proper positioning and leveling of legs and header in the wall opening. The installer then secures the rear face of the jamb by inserting the rear slide brackets into respective slot brackets and screwing the slide brackets into the rear face of the wall. Once the jamb is secured in the opening, then the door is hung. The hinges for the door are attached to the inside of the hinge leg by driving the hinge screws through the corresponding front face brackets. This technique helps to maintain the position of the door during a fire even if wood components around the hinges partially combust or degrade.

While the present invention has been particularly shown and described with reference to the foregoing preferred examples, those skilled in the art will understand that many variations may be made without departing from the spirit and scope of the invention as variously described and defined above. The description of the invention should be understood to include all novel and non-obvious combinations of elements described herein.

For example, the basic jamb constructions described above including fire-resistant components and/or intumescent materials may be used in conjunction with conventional fastening hardware. Conversely, aspects of the innovative bracket systems described herein may be used to readily install other types of jambs, for example, even jambs that are not necessarily designed to resist fire.

Modified bracket systems may be used. For example, varying numbers of brackets may be used to attach a jamb to a wall. One or more brackets may be used on each leg and header. For some applications it may be preferable to use one long continuous bracket instead of multiple brackets. It may also sometimes be desired to use fixed brackets on both the front and back sides of the jamb instead of sliding brackets on the back side.

We claim:

1. A fire-resistant jamb system comprising a wall having an opening, a fire-resistant jamb assembly including a hinge leg, a strike leg and a header, the header having a first end and a second end, the hinge leg being connected to the first end of the header, and the strike leg being connected to the second end of the header, the fire-resistant jamb assembly being dimensioned for installation in the opening of the wall, a door dimensioned for installation in the fire resistant jamb assembly, each of the legs and header of the jamb assembly including a base portion comprised of fire-resistant material and a stop portion for contacting the door when the door is closed within the fire-resistant jamb assembly, a first intumescent strip and a second intumescent strip running substantially the entire length of the base portion of the hinge leg, the first and second intumescent strips being positioned on opposite sides of the base portion of the hinge leg and between the door and the wall when the fire-resistant jamb assembly is installed in the wall opening and the door is closed within the jamb assembly, and a bracket system for securing the legs and header in the wall opening including at least one L-shaped fixed bracket configured to secure the hinge leg to the wall, the L-shaped fixed bracket wrapping around a corner of the wall, and having a first expanse parallel with the first and second intumescent strips, and a second expanse perpendicular to the first expanse and fastened to an outer surface of the wall, a hinge aligned with the L-shaped fixed bracket, for pivotally connecting the door to the hinge leg of the jamb assembly, and one or more hinge screws penetrating the hinge, the first intumescent strip, the base portion of the hinge leg, the L-shaped fixed bracket, and the wall.

2. The fire-resistant jamb system of claim 1 wherein the stop portion of the legs includes fire-resistant material.

3. The fire-resistant jamb system of claim 1, wherein the base portion of each of the legs and header comprises diatomaceous earth.

4. The fire-resistant jamb system of claim 1, wherein the door is comprised of fire-resistant material.

5. A fire-resistant jamb system comprising a jamb assembly including a hinge leg, a strike leg and a header, the header having a first end and a second end, the hinge leg being connected to the first end of the header, and the strike leg being connected to the second end of the header, each of the legs and header being comprised of wood and fire-resistant material and including a stop portion for contacting a door when the door is closed within the jamb assembly, each of the legs having a front side, a back side, a first intumescent strip running substantially the entire length of the front side, and a second intumescent strip running substantially the entire length of the back side, a bracket set including at least one L-shaped fixed bracket configured to secure the back side of the hinge leg to a wall, the L-shaped fixed bracket configured to wrap around a corner of the wall, and haying a first expanse parallel and attached to the back side of the hinge leg, and a second expanse perpendicular to the first expanse configured for fastening to an outer surface of the wall, and the door comprising a fire-resistant door attached to the front side of the hinge leg by one or more door hinges secured to the hinge leg by at least one screw that penetrates one of the door hinges, the hinge leg, the first intumescent strip, the at least one fixed bracket, and the wall.

* * * * *